US008499607B2

(12) United States Patent
Kleber et al.

(10) Patent No.: US 8,499,607 B2
(45) Date of Patent: Aug. 6, 2013

(54) FORMING OF COMPLEX SHAPES IN ALUMINUM AND MAGNESIUM ALLOY WORKPIECES

(75) Inventors: Richard M. Kleber, Clarkston, MI (US); Paul E. Krajewski, Troy, MI (US); Sooho Kim, Troy, MI (US); Curtis L. Shinabarker, Brighton, MI (US); Nicholas M Bosway, Clarkston, MI (US); Mark A. Voss, Richmond, MI (US); Gary R. Pelowski, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 865 days.

(21) Appl. No.: 12/549,632

(22) Filed: Aug. 28, 2009

(65) Prior Publication Data

US 2011/0048091 A1 Mar. 3, 2011

(51) Int. Cl.

| | |
|---|---|
| ***B21D 13/00*** | (2006.01) |
| ***B21C 23/00*** | (2006.01) |
| ***B21C 25/08*** | (2006.01) |

(52) U.S. Cl.

USPC ..... 72/379.6; 72/254; 72/260

(58) Field of Classification Search

USPC ..... 72/31.13, 60, 253.1, 254, 256, 260, 72/269, 271, 338, 341, 379.6

See application file for complete search history.

(56) References Cited

U.S. PATENT DOCUMENTS

| | | | | |
|---|---|---|---|---|
| 3,422,648 | A * | 1/1969 | Lemelson | 72/254 |
| 3,932,090 | A * | 1/1976 | Brumlik | 425/381 |
| 3,932,249 | A * | 1/1976 | Jury et al. | 72/260 |
| 5,572,789 | A * | 11/1996 | Fisher et al. | 72/254 |
| 5,974,847 | A * | 11/1999 | Saunders et al. | 72/60 |
| 2007/0236870 | A1 * | 10/2007 | Hachino et al. | 29/592.1 |

* cited by examiner

*Primary Examiner* — Teresa M Ekiert

(74) *Attorney, Agent, or Firm* — Reising Ethington P.C.

(57) ABSTRACT

A billet of an aluminum alloy or magnesium alloy is formed by a combination of forming operations into a desired article of complex, but open shape. In a first step a billet is heated and extruded to form an extruded workpiece profile having at least first and second sections of different thicknesses. The extruded workpiece may be shaped so that the respective sections are at an angle to each other. The extruded workpiece is then further formed against a forming surface so that the shape of least one of the sections is further formed toward the shape of the article. The methods are suitable for efficient manufacture of many like complex shapes such as brackets and reinforcement members, and even container pans for computers and other electronic devices.

7 Claims, 7 Drawing Sheets

FORMING OF COMPLEX SHAPES IN ALUMINUM AND MAGNESIUM ALLOY WORKPIECES

TECHNICAL FIELD

This invention pertains to the forming of articles of complex shapes (including sections with varying thicknesses) in light metal alloy starting materials. More specifically, this invention pertains to the use of a combination of extrusion forming and elevated temperature forming against a die surface to make useful structural parts that are difficult to form (or cannot be made) by a single forming operation.

BACKGROUND OF THE INVENTION

There is a desire to reduce weight in many manufactured articles. The need is acute in the manufacture of automotive vehicles but is not limited to such applications. The ability to integrate multiple thicknesses into a single part is useful for minimizing overall part mass without sacrificing strength or stiffness in selected regions. Also thin gage parts, such as sheet metal, frequently afford limited thread engagement, and thus limited holding power, for threaded fasteners. Thus the ability to selectively introduce thicker regions into a part enables the use of threaded fasteners without compromising retention, thereby facilitating part removal for replacement or service.

Aluminum alloys and magnesium alloys are available for automotive body applications and the like but these light weight materials are not usually as formable as many ferrous alloys. Metal sheets of suitable alloys of aluminum and magnesium have been formed into body panels and the like by stamping, warm stamping, fluid forming and hot blow forming. But the starting materials for such forming processes are usually sheets of uniform thickness which limit the shapes of articles that can be formed. Often it is desired to make other more complicated shapes of the same alloys such as reinforcement parts, attachment parts, stiffening parts and the like that have sections of varying thickness.

There remains a need for forming practices that can complement stamping, warm stamping or hot blow forming or the like and be applied to a primary shape light metal alloy workpiece like, for example, a billet, bar, strip, or sheet, and form the workpiece into an article having sections of varying thicknesses and, often, at varying and sharp angles.

SUMMARY OF THE INVENTION

This invention is devised for the forming of suitable light metal alloys, particularly aluminum and magnesium alloys, into unitary formed articles having sections of different thicknesses and sections that need not be co-planar.

Embodiments of this invention include one or more extrusion steps by which a starting billet is formed into a precursor workpiece shape with connected sections of desired thicknesses, which may be of different dimensions. As stated, the connected sections may be formed at predetermined angles with respect to each other. The extruded precursor piece is formed as an open shape with at least two edges that are spaced apart from the extrusion axis. In other words, the extruded body is not in the shape of a tube.

The extrusion step or steps may be performed at a suitable elevated temperature as required by the respective aluminum or magnesium alloy composition. Typical billet temperatures for extrusion of aluminum alloys range from about 425 to 500° C.; for extrusion of magnesium alloys billet temperatures of between 300 and 450° C. are preferred. The extruded shape may then be heat treated if necessary so that it may be further shaped by hot stamping, hot blow forming, or the like.

The temperature of the extrudate will be greater than the temperature of billet from which it formed due to the deformation work required in extrusion and will typically be comparable to that employed in hot forming. Thus, appropriate coupling and sequencing of the extrusion and hot forming operations will at least minimize and may eliminate the need for a separate heating step prior to hot forming.

In many embodiments of the invention a long extruded precursor shape may be sheared or cut at desired distances along the axis of extrusion to form blanks suitable for subsequent forming.

The extruded precursor shape is then heated to a suitable elevated temperature, if necessary, and further formed by urging it against a heated forming tool or heated die surface. A surface of the extruded article is forced into suitable contact with the heated tool so that the engaging surface of the article acquires the shape of the tool. For example, the extruded shape may be pressed by a complementary tool or die into sliding, metal forming engagement against the forming surface as in a hot stamping practice. Aluminum and magnesium alloy workpieces can be subjected to hot stamping in a temperature range of about 200° C. to about 350° C. In another embodiment, the extruded workpiece is heated to a highly formable state and fluid pressure is applied to one side of the workpiece to force the other side into conforming shape with a heated die or tool. Hot blow forming of aluminum alloy and magnesium alloy workpieces is often performed at workpiece and tool temperatures in the range of about 400° C. to about 500° C.

It is contemplated that much of the shaping of the article will be accomplished by a combination of the extrusion steps and hot forming steps or, where applicable, conventional forming steps. However, it is recognized that a suitable starting shape for the extrusion step is required. And it is further recognized that some finishing steps, such as trimming, hole forming, and the like, may be required on the hot formed shape.

Other objects and advantages of the invention will be apparent from the following detailed descriptions of illustrative embodiments of practices of the invention. Reference will be made to drawing figures that are described in the following section of this specification.

BRIEF DESCRIPTION OF THE DRAWINGS

FIG. 1A shows a suitable extruded form; FIG. 1B shows the form of FIG. 1A located in a suitable forming apparatus shown in partial cutaway; FIG. 1C shows the formed part; and FIG. 1D shows the finished part.

FIG. 2A shows an extruded form; FIG. 2B shows the extruded form of FIG. 2A after further shaping; FIG. 2C shows the formed part; and FIG. 2D shows the finished part.

FIG. 3A shows an extruded form; FIG. 3B shows the extruded form of FIG. 3A after further shaping; FIG. 3C shows the extruded form of FIG. 3B and associated die portion after further shaping; FIG. 3D shows the finished part.

DESCRIPTION OF PREFERRED EMBODIMENTS

Magnesium and aluminum alloys may be readily extruded. The extrusion process, which involves forcing materials through a shaping die, is a well-developed, low-cost process which is inherently capable of producing forms of varying thickness. Further, unlike the flat sheet of uniform thickness which is the starting material for most sheet forming processes, extrusion is capable of forming much more complex geometries along the length of the extrudate.

Figure 1A:
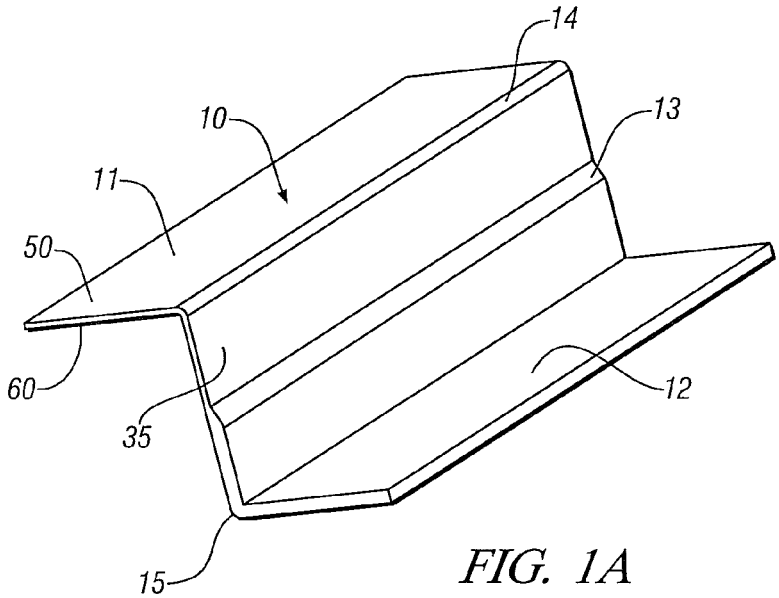
FIGS. 1A-D show a sequence of operations suitable for forming a fender reinforcement by the practice of the invention.

By way of example only, the form shown in FIG. 1A which combines segments of unequal thickness inclined at about right angles to one another is entirely suitable for fabrication by extrusion. Further the junction between the inclined sections may be made with only a small radius conferring a 'crisp' appearance not always achievable in formed or bent sheet metal components.

These characteristics: the suitability of the light metal alloys of aluminum and magnesium for extrusion; the ability of the extrusion process to produce shapes of varying thickness; and the ability of the extrusion process to produce other than planar geometric forms are used in this invention to beneficially complement current sheet forming processes for these light metals.

The invention applies sheet forming processes to forms of complex starting geometries developed by extrusion to enable the manufacture of complex structural forms and attachments. These structural forms and attachments may thus be made of alloys identical to or compatible with the alloys employed in stampings formed from current sheet compositions.

It is well known that the formability of magnesium and aluminum may be enhanced by conducting forming at elevated temperature and thereby enabling the formation of more complex shapes. In practice of this invention similar elevated temperature forming practices may be followed, but are not required if forming at lower temperatures such as room temperature, generally about 25° C., is adequate for achieving the desired form.

The invention may best be understood by consideration of the following examples. It will be appreciated that the output of extrusion processes is a part which is of limited extent in the two dimensions defining the cross-section of the extrusion but is extensive in the third, length dimension. Further it is known that asymmetrical extrusions or of non-uniform cross-section frequently exhibit twist or bend along their length. It is however common practice to straighten or untwist the extruded part by controlled application of plastic deformation in a post-extrusion stretching or twisting process. It is also well known to cut the extrudate into a number of smaller, commonly-dimensioned parts so that a single extruded length, when sectioned, will yield multiple parts. In the practice of the following examples these preliminary operations will not be further discussed. The focus will be on the subsequent processing of these commonly-dimensioned parts which, by analogy with conventional sheet forming terminology will be described as extruded blanks in future descriptions.

EXAMPLE 1

A Fender Reinforcement

In this example an aluminum or magnesium alloy bracket or reinforcement member is made for use, for example, in attaching a polymeric fender to a space frame body structure. Four or more such parts might be used in the making of a vehicle body.

FIG. 1A shows a section 10 of an extruded form comprising two thicknesses of extrudate and generally resembling the letter "Z". The extrudate comprises a first segment 11, a second segment 12 and a connecting segment 35 joining segments 11 and 12. The material thickness in segment 12 is greater than the material thickness in segment 11. Connecting segment 35 has a portion comprised of material of thickness corresponding to segment 11 and a portion comprised of material of thickness corresponding to segment 12 with a progressive transition from one thickness to the other in region 13. Segment 11 adjoins segment 35 along line 14 corresponding to a generally 90° change in inclination while segment 12 adjoins transition segment 35 along line 15 again corresponding to a generally 90° change in inclination. If these changes in inclination between the part segments at lines 14 and 15 were formed by bending they would be considered small radius bends, that is bends in which the bend radius is comparable to the metal thickness. The formation of small radius bends is challenging, particularly in materials of limited ductility, and the ability to impart this shape by extrusion appreciably simplifies forming complex geometric forms in thin components.

Figure 1B:
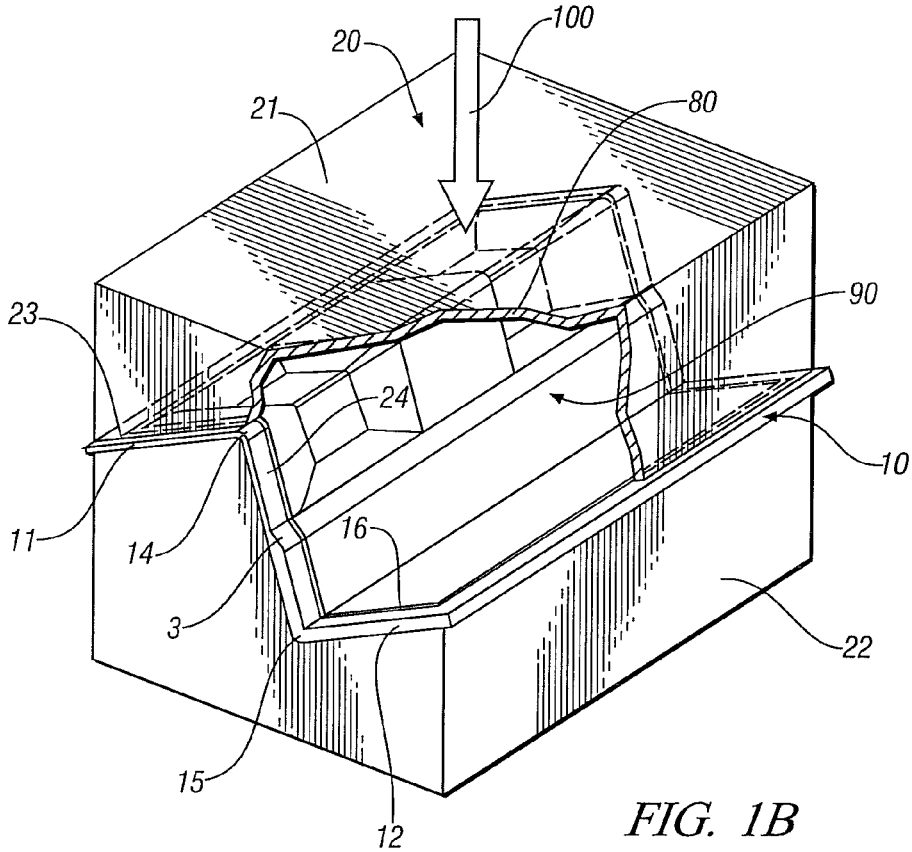

FIG. 1B shows the extruded form 10 of FIG. 1A positioned in a hot forming die 20 comprising an upper section 21 and a lower section 22 with these sections positioned in a press capable of applying mechanical force in a direction indicated by arrow 100. Forming is accomplished by first heating the die and sheet to a temperature in the range of 400 to 500C and applying gas pressure (up to 500 psi) to one side of the sheet thereby inducing the sheet to bulge and deform into contact with a shape imparting die. In FIG. 1B, the die section is the lower section 22 and its interior geometry (shown partially in ghost) generally corresponds to the resulting part geometry shown in FIG. 1C. Upper section 20 is primarily a pressurization chamber, comprising a sealing shell 80 and interior cavity 90.

To assure good gas sealing, the periphery of upper and lower dies 21 and 22 substantially reproduce the upper and lower surfaces 50, 60 of extruded blank 10, see FIG. 1A. Sealing is further assured by the introduction of a seal 16, shown in FIG. 1C, resulting from the cooperative interaction of features on upper die 21 and complementary features on lower die 22 which result in a local offset of the surfaces 50, 60 of blank 10 and thereby define a substantially leak-free pressurizable cavity 90 within upper die 21.

Figure 1C:
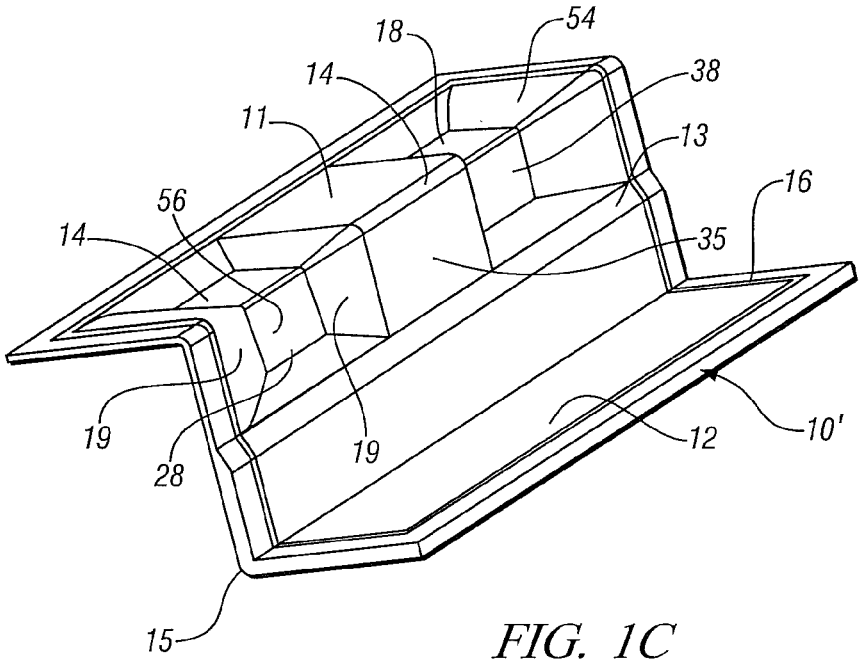

Upon exposure to appropriate gas pressure the extruded blank 10 will adopt, with fidelity dependent on the magnitude of the applied pressure, the general form of lower die 22 and the formed part 10', shown in FIG. 1C, may be removed. Comparison of FIGS. 1A and 1C reveals that the general "Z" form of blank 10 has been retained but that the forming step has enabled the formation of 'pocket'-like features 54, 56 comprising substantially vertical surfaces 19, 28 and 38 and substantially horizontal features 17 and 18 located on surfaces 11 and 35 of blank 10.

Figure 1D:
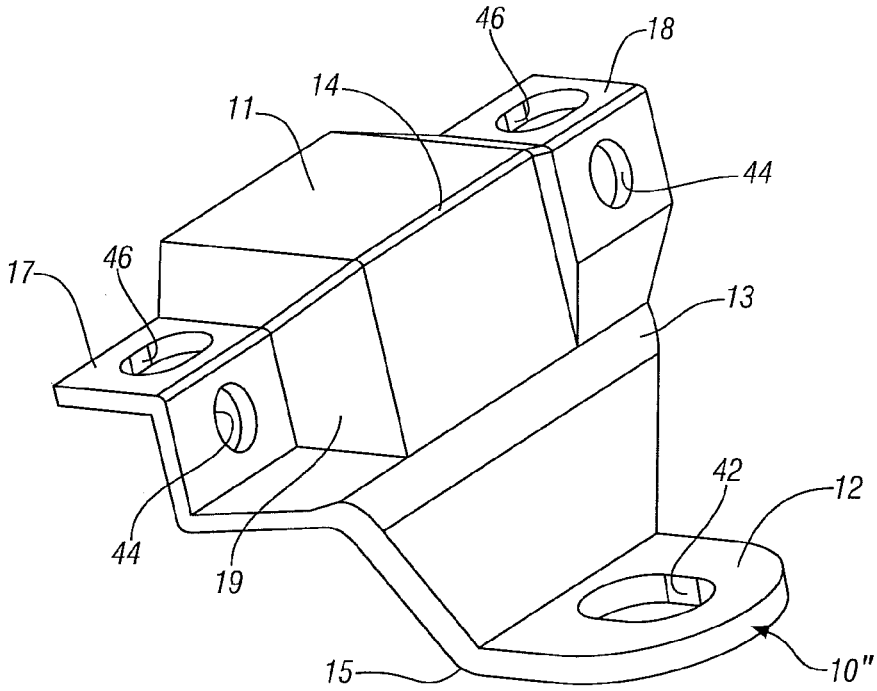

Further processing, trimming of metal excess to the part and fabrication of holes 42, 44 and 46 for example, by punching or machining results in the finished part, a bracket 10", shown in FIG. 1D. Hole 42 is illustrated as a slotted hole which may be desirable for adjustment, particularly for a bracket like that shown. It will be appreciated that the shape of holes 42, 44 and 46 is not restricted to the geometries shown but may instead generally adopt any configuration which meets the desired engineering function.

It will be appreciated that the selected die geometry was complementary to the desired part geometry and supported thicker section 12 and enabling development of additional shaped features in thinner section 11. However, by appropriate choice of thicknesses, the strength mismatch between the thick and thin sections may be made sufficient as to render the thick section substantially un-deformable under conditions leading to the deformation of the thinner section. In this situation die support for the thicker section will be unnecessary and simpler dies may be employed. This may be particularly desirable for closed section, or tubular, forming where thickness variations in tube wall thickness could be introduced to suitably channel the deformation when the tubes are subject to internal pressurization at elevated temperature.

The process has been depicted as it would be practiced in forming only a single part in each forming operation. However, particularly for small parts, it may be more efficient to employ a longer extruded blank and place it in a die with multiple cavities so that multiple parts may be formed in a single forming operation. After forming they would be separated to create the desired part 10".

The forming process for this part has been described as fabrication of an extruded blank and warm or blow forming. However those skilled in the art will appreciate that if the pocket-like features are relatively shallow and easily formed it may be possible to form them using press forming, conventional forming technology employing matched die sets in a mechanical or hydraulic press. Press forming may be carried out at elevated temperature or at room temperature, generally about 25° C. In this case the need to have the direction of the metal flow aligned with the action of the press will necessitate positioning the extruded blank in a different orientation in the press than is shown in FIG. 1B. However, the importance of appropriate 'die tip' in achieving optimal forming performance is well known to those skilled in the sheet forming art.

EXAMPLE 2

Bracket

In this example another aluminum or magnesium alloy bracket or reinforcement member is made for use, for example, in making a vehicle body structure. Several such parts might be used in the making of a vehicle body.

In Example 1, the extruded blank was used directly and the required trimming was performed subsequent to the forming operation. The extruded blank however may require additional trimming prior to forming to render its shape suitable for the specific forming operation contemplated. In this example, shown in FIG. 2A, the extruded blank 110 has a form generally resembling the letter "L" with a first segment or leg 111 of the "L" being thinner than the second segment or the second leg of the "L" 112. In this example the transition from thick section to thin section occurs generally at small radius outer bend 113, the specific location being dictated by the need to achieve a smooth transition from the thick to thin sections and therefore dependent on the specific radius selected for inner bend radius 114.

Figure 2A:
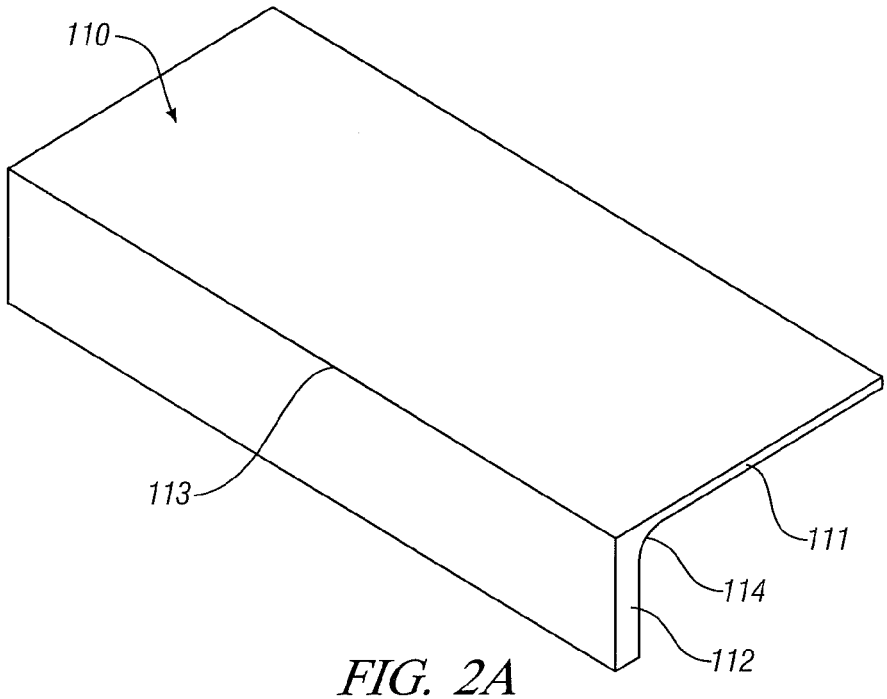
FIGS. 2A-D show a sequence of operations suitable for forming a bracket by the practice of this invention.
Figure 2B:
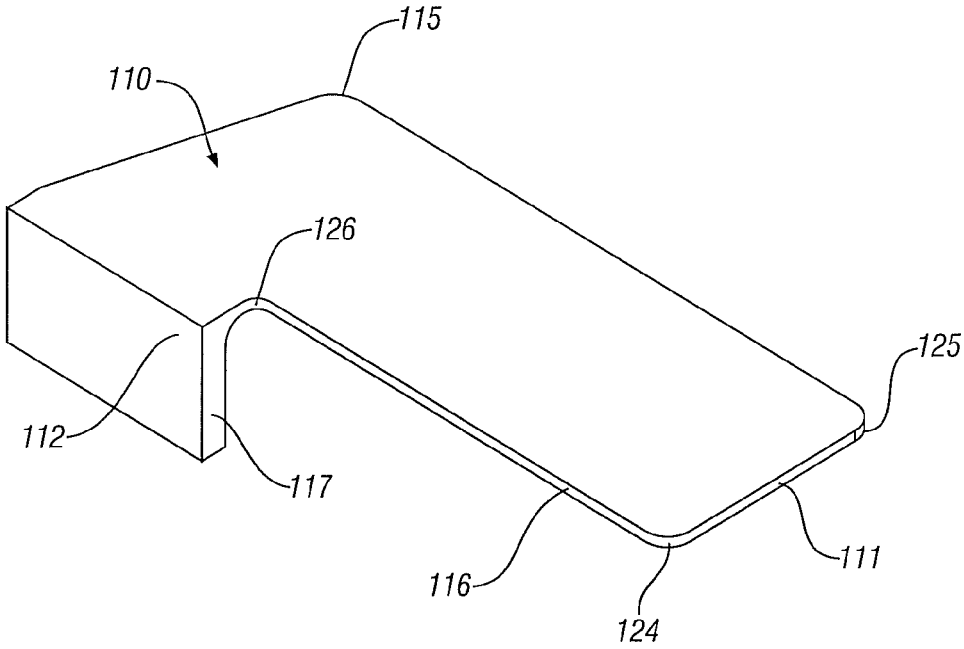

In FIG. 2B, the extruded blank has been further processed and trimmed, removing a portion of section 112 and thereby creating surfaces 116 and 117 as well as generating radiussed, in plan view, corners 115, 124, 125 and 126, here shown as commonly dimensioned for convenience only. This geometry may be developed using a cutting or shearing operation using matched cutting edges urged together by, for example, a press, or alternatively by a machining operation such as sawing or milling.

Figure 2C:
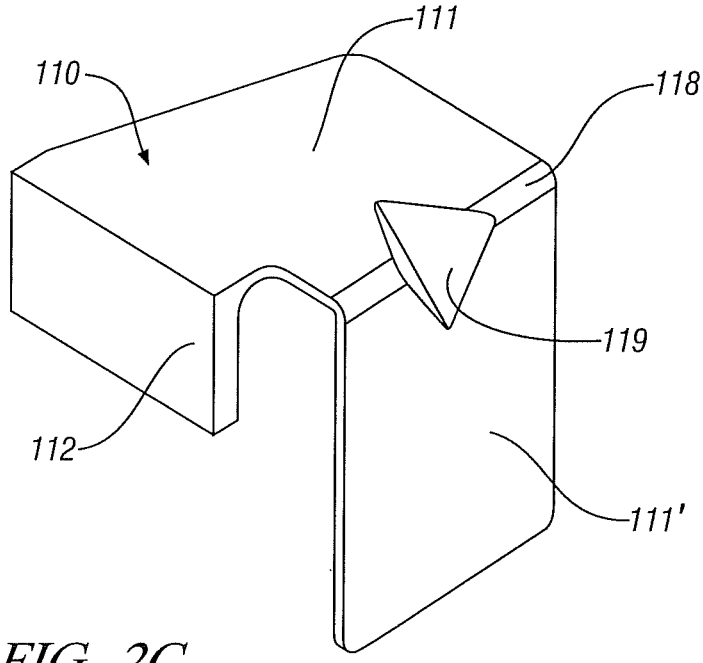

FIG. 2C illustrates the form of blank 110 after two forming operations in a press: a bending operation to create a bend along bend axis 118 and thereby form a section of horizontal segment 111 into a vertical orientation shown as 111'; and an operation to form dart 119 along the bend line 118 and thereby stiffen the bend to render it more resistant to unbending in service. These features may be introduced in a single press operation or in two separate press operations and may be performed with the die and workpiece at room temperature, that is at around 25° C., or at elevated temperature depending on the formability and ductility of the workpiece.

Figure 2D:
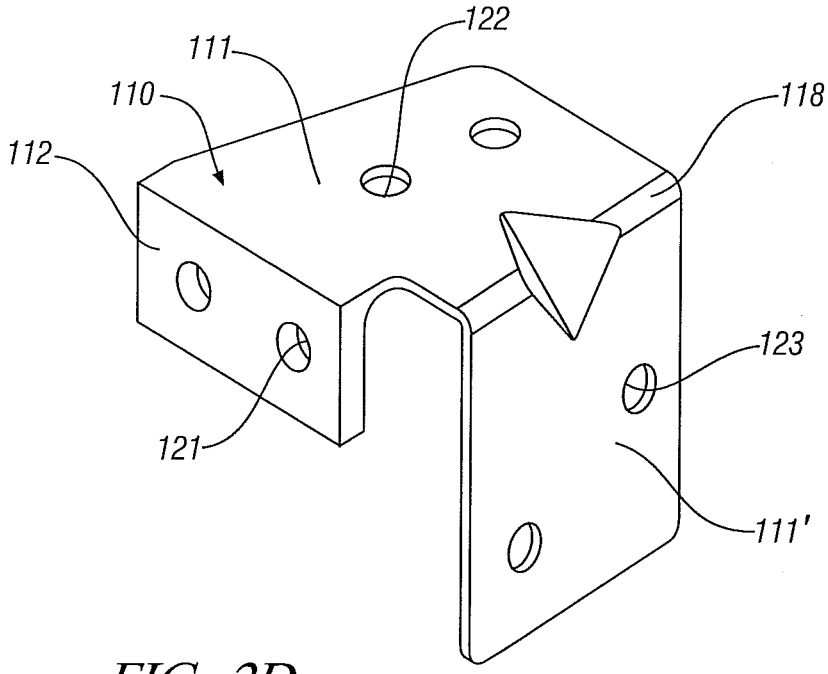

In FIG. 2D, the bracket-like component has been subjected to additional shaping to introduce holes 121, 122 and 123. As was the case for Example 1 the geometry of the holes may be circular (as depicted), slotted, oval or any other configuration which satisfies the engineering requirements and the holes may be fabricated by press operations like punching or by machining, for example by drilling or milling.

In this case however, the hole making operation may precede the forming operation and may even be conducted on the original extruded blank shown in FIG. 2A. Generally introducing holes prior to forming is discouraged due to the difficulty of precisely locating the holes in the finished part, but if the hole positions are loosely toleranced this may be an acceptable procedure. Thus the sequence of operations shown in FIGS. 2 A-D may be modified without necessarily affecting the utility of the formed part.

EXAMPLE 3

Case for an Electronic Device

In this example a pan structure of light weight aluminum or magnesium alloy is made with integral reinforcing or spacing ribs being formed in the base of the pan. The pan may be used as an enclosure for a computer or other electronic device.

Figure 3A:
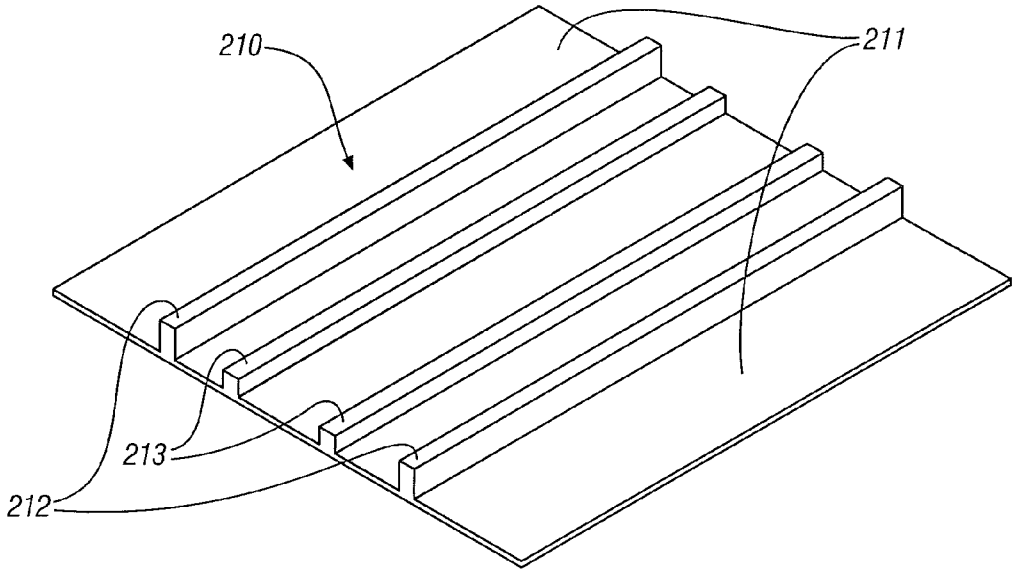
FIGS. 3A-D show a sequence of operation suitable for forming a case for an electronic device by the practice of this invention.

In this example, the extruded blank 210 shown in FIG. 3A comprises a generally flat horizontal base 211 of generally uniform thickness with a plurality of integral, parallel, stiffening features 212 and 213 that extend upwardly from a surface of base 211. Stiffening features 212 and 213 may, as shown, in FIG. 3A and subsequent, be of differing height and will extend along the length of the blank.

Figure 3B:
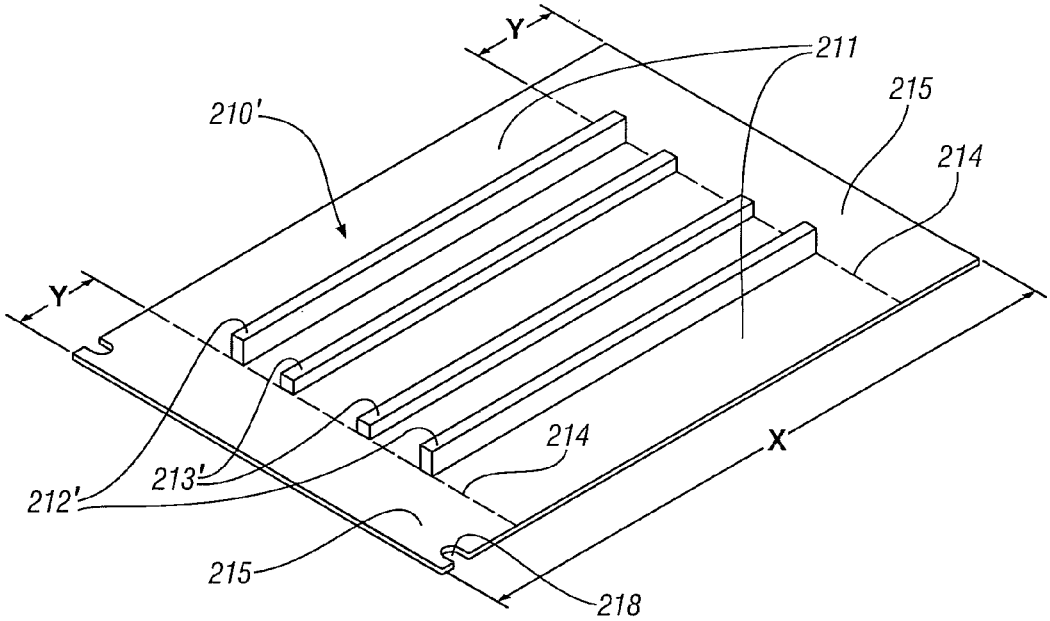

In the configuration shown in FIG. 3A, the blank 210 will be more resistant to deformation in a direction substantially orthogonal to the orientation of ribs 212, 213 and less resistant to deformation in a direction generally aligned with the orientation of ribs 212, 213. To enable more homogenous deformation, at least on the periphery of blank 210, the ribs 212 and 213 may be machined off along lines 214 and 216 to create regions 215 of thickness substantially equal to that of the planar region 211 of extruded blank 210 leaving residual rib sections 212' and 213'. Thus, as shown in FIG. 3B a perimeter region of substantially equal thickness and hence substantially equal resistance to deformation has been created around the perimeter of extruded blank 210, thereby creating extruded blank 210'.

A similar result may be achieved by welding, for example using a laser, additional sections to extend the length of the blank 210 shown in FIG. 3A and create an extruded tailor welded blank. Further the process has been described as cutting an extrudate to form an extruded blank followed by machining to create the form of FIG. 3B. However it will be appreciated that the extrudate may be machined first and then cut to create blank 210'. For example:

a) face mill to create in the extrudate a uniformly spaced array of stiffening rib-free regions of width (2× "Y") and of thickness generally equal to that of region 211 a distance "X" apart; and b) repeatedly shear the milled extrudate in the middle of the milled section. A cutting process, for example sawing or milling rather than a shearing process may be employed provided allowance is made for kerf losses Extruded blank 210' exhibits representatively-positioned locator features 218, here shown as parallel-sided slots terminated in a semi-circular arc, intended to engage with mating locators in the die to enable accurate placement of the blank in the die. Alternate locator geometries are however well known. For example tapered slots terminated in a semi-circular arc are frequently employed. This configuration provides some self-guiding characteristics to the locators if the locating pins in the die, rather than being fixed, shuttle between a blank load/unload position and a stamping position.

Figure 3C:
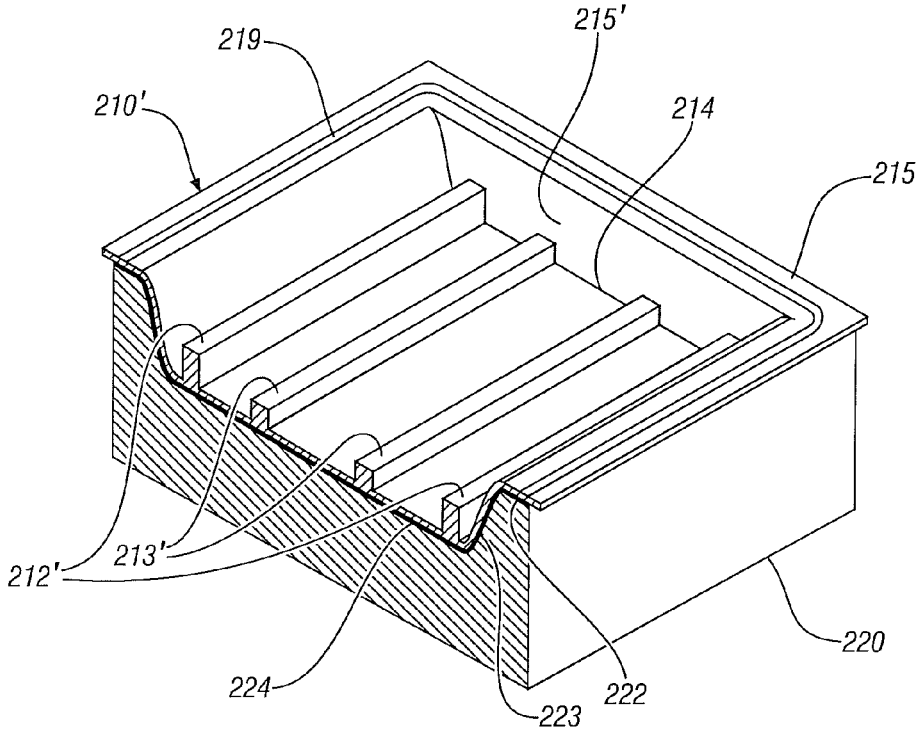

FIG. 3C shows a cutaway view of the extruded blank 210' located in the lower, die section 220 of a die-set intended for hot or warm forming. Analogously to Example 1, the die-set comprises a lower, die, section 220 and an upper section (not shown) capable of imparting gas pressure to one side of blank 210' to urge it against forming surface 224. In common with Example 1, the periphery of the upper and lower dies substantially reproduces the upper and lower surfaces of extruded blank 210'. Sealing is further assured by the introduction of a seal bead 219 around the periphery of blank 210'. Seal bead 219 is formed by the action of a continuous protruding feature on the upper die intended to at least partially penetrate the upper surface of blank 210' and thereby define a substantially leak-free pressurizable cavity within the upper die.

Upon exposure to appropriate gas pressure, typically up to 500 psi at a temperature of between 400 and 500° C. the extruded blank 210' will adopt the general form of lower die forming surface 224 to create the formed part. For the example shown in FIG. 3C the originally flat blank has been shaped into the form of a rectangular pan. The central portion where stiffening ribs 212' and 213' remain undergoes only limited deformation, with most of the shape change occurring in the uniform-thickness periphery of the blank. A portion of the periphery 222 supports the sealing bead 219 while the remainder forms wall sections 223 and 215', thereby forming a flat-bottomed rectangular pan with stiffened bottom.

While the example shown undergoes only limited deformation in its interior portion, alternate deformation patterns, and in consequence alternate final part geometries, may readily be promoted by adjustment of die surface 224 and by selective removal of ribs 212' and 213' or portions thereof.

Figure 3D:
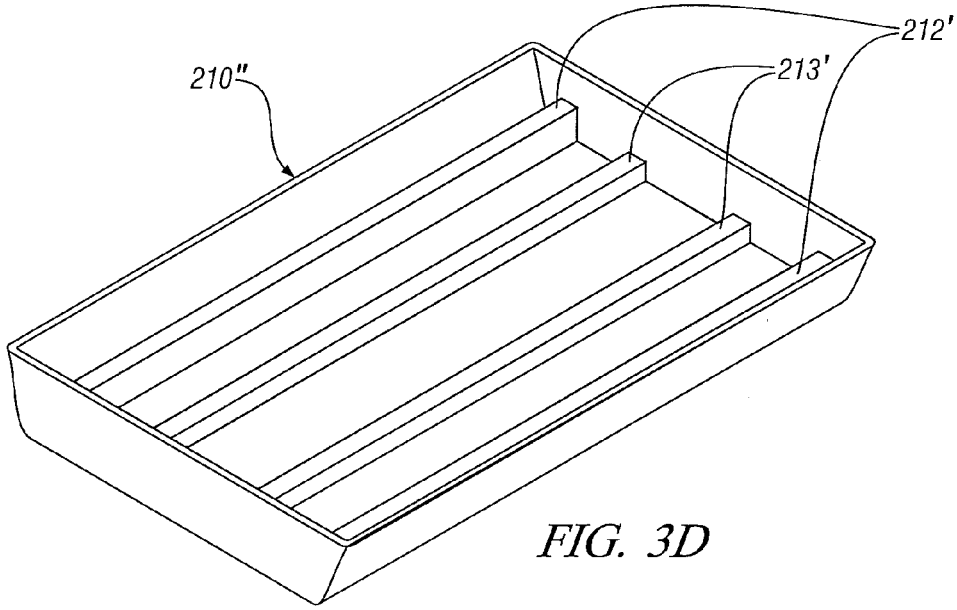
Figure 3E:
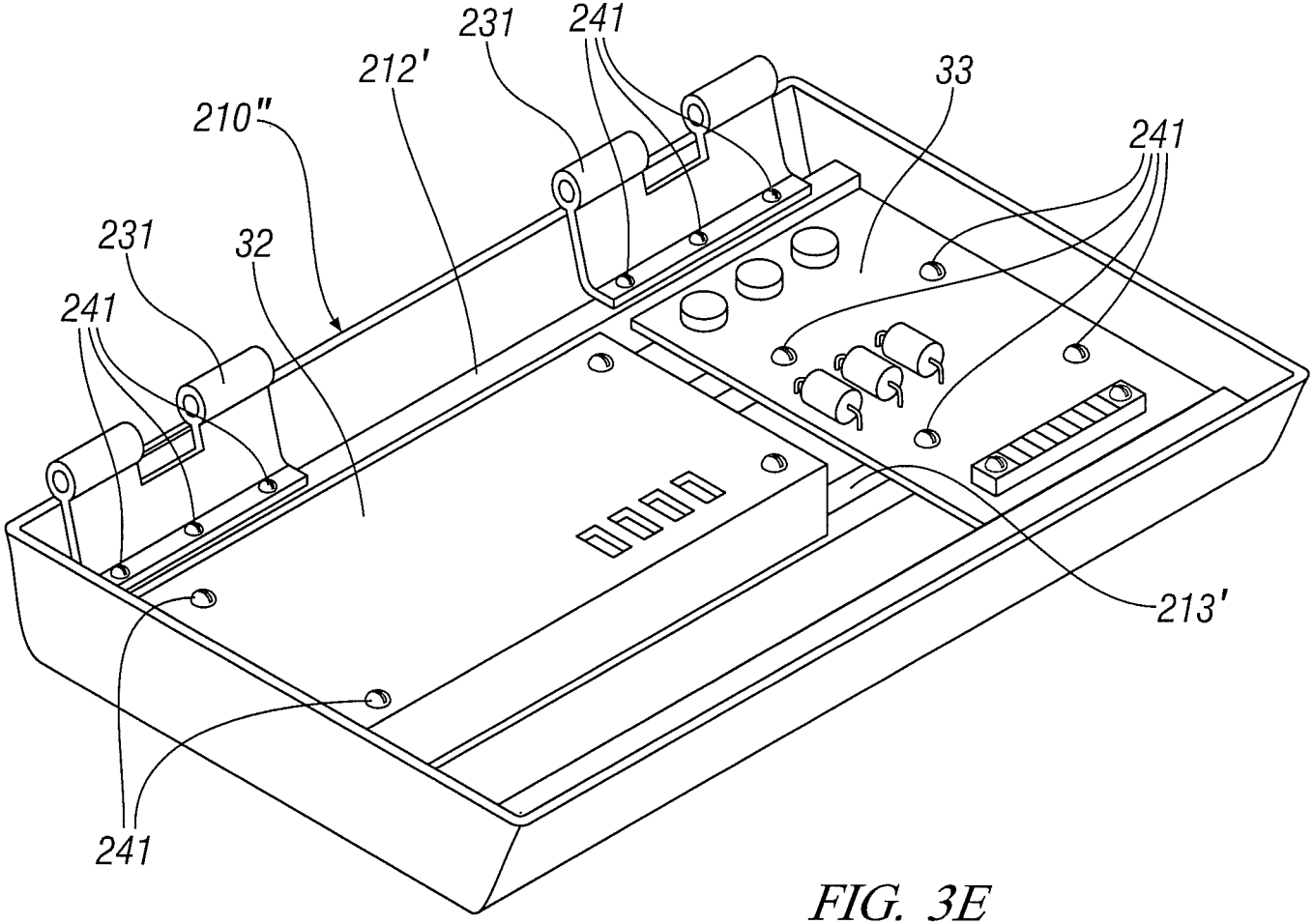
FIG. 3E shows the finished part of FIG. 3D with components assembled in a configuration suitable for use.

Trimming off peripheral flanges 222 and 215 results in finished part 210", shown in FIG. 3D. This part may readily be adapted as a portion of a container for electronic devices as shown in FIG. 3E, wherein components 32 and 33 are shown attached to stiffening ribs 212' and 213' and hinges 231 are shown attached to stiffening rib 212'. Thus, stiffening ribs 212' and 213' convey dual benefit in stiffening the flat bottom of the pan-shaped part and providing sufficient thickness to enable good retention and tensioning of removable threaded or mechanical fasteners 241.

It will be appreciated that insertion of mechanical fasteners will require at least fabrication of holes in the stiffening ribs. Such holes, typically blind holes if appearance is an issue, may be made by drilling.

Although the present invention has been described with reference to preferred embodiments and examples, workers skilled in the art will recognize that changes may be made in form and detail without departing from the spirit and scope of the invention.

The invention claimed is:

1. A method of forming a pan with a pan base comprising parallel integral raised elongated rib features, the method comprising;

extruding a billet along an axis of extrusion to form an extrudate, then cutting the extrudate in a direction perpendicular to the axis of extrusion to form one or more extruded workpieces, each workpiece comprising a rectangular, generally planar base with two opposing base sides being the lateral sides of the extruded workpiece and the other two rectangle sides being transverse to the direction of extrusion, the planar base being formed with a plurality of parallel ribs extending upwardly from a common surface of the base and extending from one transverse side of the base to its opposing side, the ribs being spaced from the lateral sides of the base;

cutting rib portions from the transverse sides of the base to provide a preform for the shaping of opposing pan walls; and forming a pan by urging the pan preform against a die surface in a pan-shaped die cavity to form pan walls, with corner intersections, from the lateral sides of the base and from the transverse sides of the base from which rib material was removed.

2. The method of claim 1 wherein rib portions are removed by machining.

3. The method of claim 1 wherein any excess material at the corners of the pan is trimmed from the pan by shearing.

4. The method of claim 1 wherein ribs are of suitable width and height to accept a threaded fastener.

5. The method of claim 1 further comprising fabricating holes in the pan by drilling or punching.

6. The method of claim 1 wherein the forming is hot forming conducted at a temperature range of from 300-500° C.

7. The method of claim 1 wherein the forming is hot forming conducted by application of gas pressure to one side of the extruded workpiece to urge it against a shaped die.

* * * * *